United States Patent [19]

Echeverria

[11] Patent Number: 4,554,746

[45] Date of Patent: Nov. 26, 1985

[54] SELF-LOCKING-AND-MEASURING RULER FOR COMPUTER-PRINTOUT FORMS

[76] Inventor: Luis Echeverria, 1501 Silliker, La Habra, Calif. 90631

[21] Appl. No.: 627,869

[22] Filed: Jul. 3, 1984

[51] Int. Cl.[4] ..... B43L 13/24

[52] U.S. Cl. ..... 33/447; 33/450; 33/473

[58] Field of Search ..... 33/1 D, 436, 437, 446, 33/447, 450, 464, 469, 473

[56] References Cited

U.S. PATENT DOCUMENTS

| | | | |
|---|---|---|---|
| 393,290 | 11/1888 | Both | 33/450 |
| 471,428 | 3/1892 | Miller | 33/450 |
| 1,632,267 | 6/1927 | Beem | 33/473 |
| 3,145,589 | 8/1964 | Jonker | 33/447 |

FOREIGN PATENT DOCUMENTS

| | | | |
|---|---|---|---|
| 59774 | 6/1913 | Austria | 33/447 |
| 361573 | 10/1922 | Fed. Rep. of Germany | 33/464 |
| 591790 | 1/1934 | Fed. Rep. of Germany | 33/447 |
| 184172 | 7/1966 | U.S.S.R. | 33/469 |

*Primary Examiner*—Richard R. Stearns
*Attorney, Agent, or Firm*—Francis X. LoJacono

[57] ABSTRACT

The present invention provides a self-locking-and-measuring, straight-edge apparatus designed to allow one to very accurately draw spaced parallel lines, particularly horizontal ones, the straight-edge being especially designed for ruling computer-printout forms. The apparatus comprises a scaled guide bar that is affixed perpendicularly to a drafting table, or the like, on which a straight-edge assembly is slidably and adjustably mounted, so as to move longitudinally along the scaled guide bar. The straight-edge assembly includes a base plate having a spring-biased latch positioned to selectively engage any one of a plurality of scaled notches formed along the longitudinal edges of the scaled guide bar. A straight edge is adjustably attached to the base plate.

5 Claims, 5 Drawing Figures

10
12
14
16
18
19
20
22
24
26
28
32
34
40
44
46
48
50
52
55
56
60
62
64
66
68
70
72
3
4

SELF-LOCKING-AND-MEASURING RULER FOR COMPUTER-PRINTOUT FORMS

BACKGROUND OF THE INVENTION

1. Field of the Invention

This invention relates generally to a measuring instrument, and more particularly to a self-locking-and-measuring ruler having many measures of notched scales for the drawing of parallel lines at precise intervals.

2. Description of the Prior Art

Problems and difficulties are being encountered in providing suitable means for measuring distances so as to properly locate lines on business forms, especially computer-printout forms. At present, it is very difficult, no matter how carefully a sheet is pre-measured, for the desired lines to fall exactly on the measured marks. If only one line is inaccurately drawn, it often results in additional uneven spaces, thus compounding the error in any given measured length. The measuring and placing of lines on computer-printout sheets is very critical due to the accuracy of the printout itself. Hence, there is no room for error.

There are various types of known ruling devices, none of which is believed to have the particular features as herein disclosed in the present application. Many of the known devices have inherent features that restrict their use, and they are often not as accurate as they were intended to be for measuring purposes. Also, some devices are complicated to operate and expensive to maintain.

As examples of related devices, one may refer to the following United States patents:

U.S. Pat. No. 245,726 relates to a T-square for a school slate on which lines can be drawn.

In U.S. Pat. No. 419, 640 a glass-cutting-and-drawing frame is disclosed wherein two edges of the frame are provided with notches.

U.S. Pat. No. 2,439,291 discloses a set-shift, parallel, ruling device which includes a rack and pinion arranged between the base member and the straight edge.

A combined drill guide and inspection device is disclosed in U.S. Pat. No. 3,145,589.

However, none of the above patents provides a means for establishing an accurate measuring and ruling for computer-printout sheets.

SUMMARY OF THE INVENTION

The present invention has for an important object to provide a self-locking-and-measuring device having an elongated, scaled, guide bar which is secured to a table top, and to which a straight edge or blade is adjustably mounted by means of an adjustable body plate. The body plate includes a spring-loaded latch positioned to selectively engage any one of a plurality of scaled notches formed along the longitudinal edges of the guide bar, whereby predetermined spaced lines can be accurately drawn.

Another object of the invention is to provide a self-locking-and-measuring-scale-type unit that is particularly designed for lining computer-printout forms.

Still another object of the invention is to provide a device of this type wherein the body plate of the straight edge is provided with a guide pin which is received in the longitudinal groove formed in the scale-guide member, thus allowing the straight edge to be moved along the guide member so as to achieve a very accurate perpendicular alignment with the guide member.

A further object of the present invention is to provide a device of this character that overcomes the inaccuracy encountered in ruling business forms by eye.

It is a further object of the present invention to provide a device of this character that is easily adjustable to selective settings, the device requiring relatively few operating parts.

It is still a further object of the invention to provide a device of this character that is easy to service and maintain, and is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figures 1, 2:
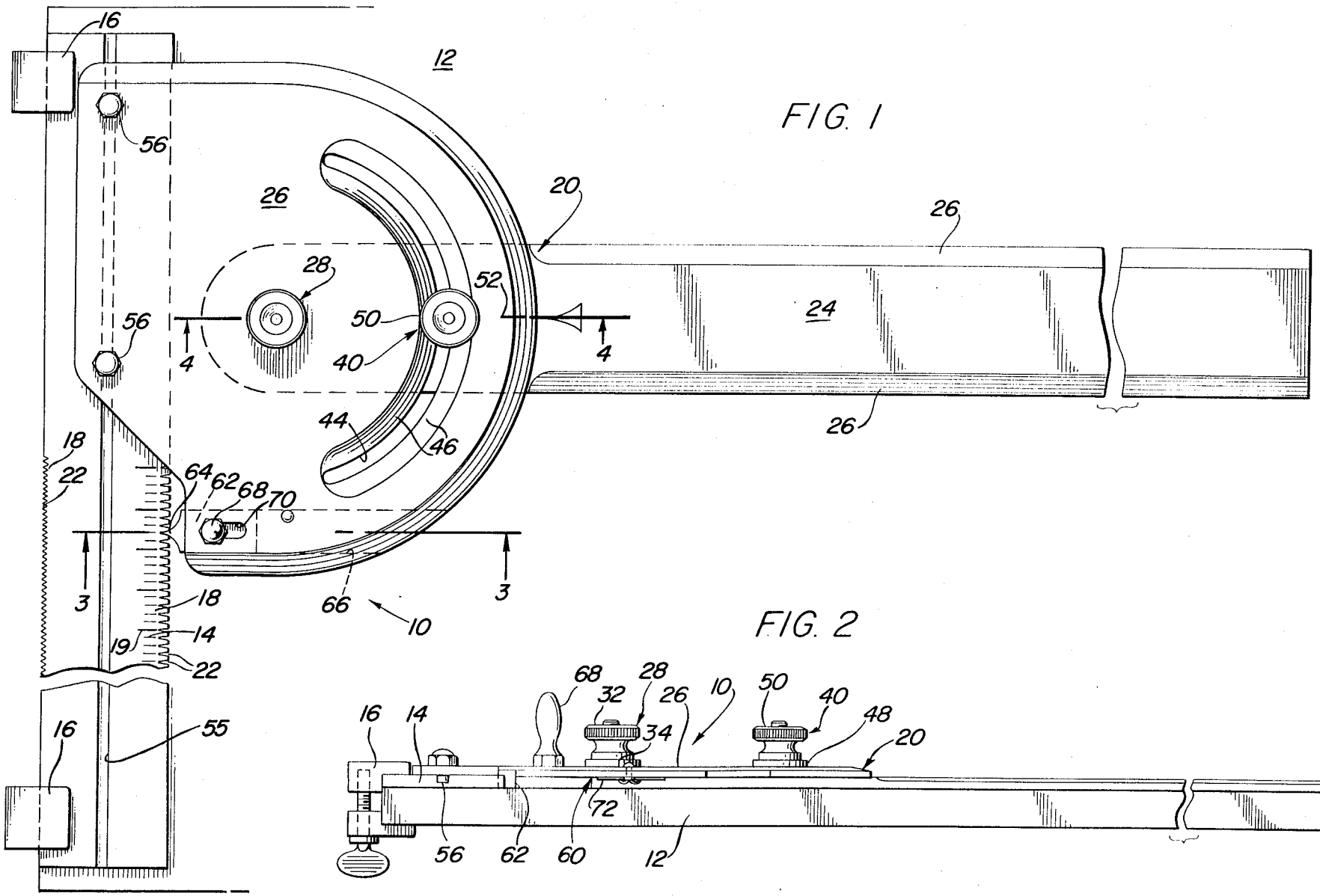
FIG. 1 is an enlarged top-plan view of the invention, showing the scale-guide bar secured to a table with the guide bar and straight edge broken away due to the overall length.
FIG. 2 is a side-elevational view thereof.
Figure 3:
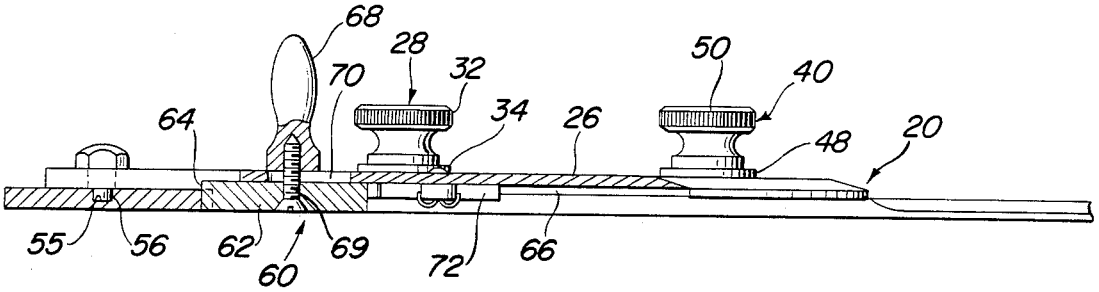
FIG. 3 is an enlarged cross-sectional view taken substantially along line 3—3 of FIG. 1.

Referring more particularly to FIGS. 1 and 2, there is shown a self-locking-and-measuring device, generally indicated at 10, being secured to a flat table or like structure 12. The present invention is specifically designed to provide a means by which accurately spaced horizontal lines can be drawn on computer-printout sheets.

In order to accomplish this end result, the present device comprises a scaled guide-bar member 14 which is placed generally along the perpendicular edge of table 10 and secured thereto by any suitable fastening means, such as by clamp members indicated at 16. The scaled guide bar 14 is formed as an elongated member of sufficient length to allow the straight-edge assembly, designated at 20, to be selectively positoned at any point along the scaled edge of guide bar 14. That is, both longitudinal edges 18 of guide bar 14 are provided with a plurality of contiguously formed notches or slots 22. These notches may be graduated to establish any given or selected scale, the notches being cut at specified intervals so that the scales may be in sixteenths and tenths of an inch, as well as in metric measurements. Thus, one edge may have a different scale than the other.

Figure 4:
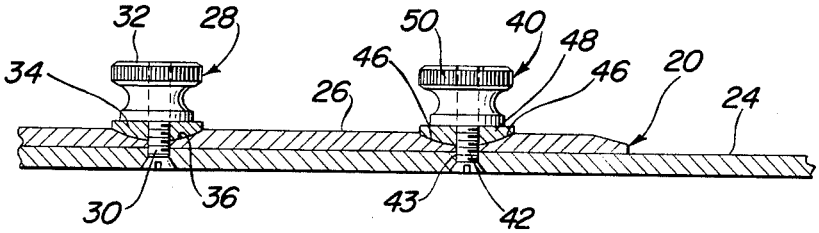
FIG. 4 is an enlarged cross-sectional view taken substantiallv along line 4—4 of FIG. 1, showing the arrangement of both the blade-swivel nut and the blade-locking nut.

Straight edge or blade assembly 20 comprises a straight-edge member 24 having at least one (but preferably two) oppositely disposed, beveled, horizontal edges 26 which can be of any suitable length, or a length equal to or greater than the width of the printout sheet on which the lines are to be drawn. Straight edge member 24 is pivotally attached to a body or base plate 26 by pivot means 28 which comprises a screw pin 30 mounted in straight edge 24 and passing up through base plate 26, as illustrated in FIG. 4. A finger nut 32 is adapted to be threadably fastened to pin 30, a washer 34 being interposed between nut 32 and base plate 26 which has a recess 36 to receive the convexed surface of washer 34. Thus, straight edge 24 may, when required, be moved about the axis of screw pin 30. However, there is also provided a locking means, indicated at 40 which comprises a nut assembly including screw 42 fixedly mounted in straight edge 24 by means of bore 43. Screw 42 passes through an arcuate slot 44, seen in FIGS. 1 and 5. The slot 44 includes concave shoulders 46 formed to receive the convexed surface of washer 48. A second finger nut 50 is threadably attached to screw 42, so as to allow straight edge 24 to be locked in place. Base plate 26 and blade 24 each are provided with horizontal markers 52 and 54, respectively.

In order to mount base plate 26 at a given slidable position relative to guide bar 14, there is provided a guide means which is defined by a longitudinal groove 55 disposed in guide bar 14, the groove being adapted to receive a pair of aligned guide pins 56 which are mounted to extend below plate 26. Hence, straight-edge assembly 20 is slidably attached to guide bar 14, and the assembly can only be moved along guide bar 14 in a perpendicular relationship thereto.

Figure 5:
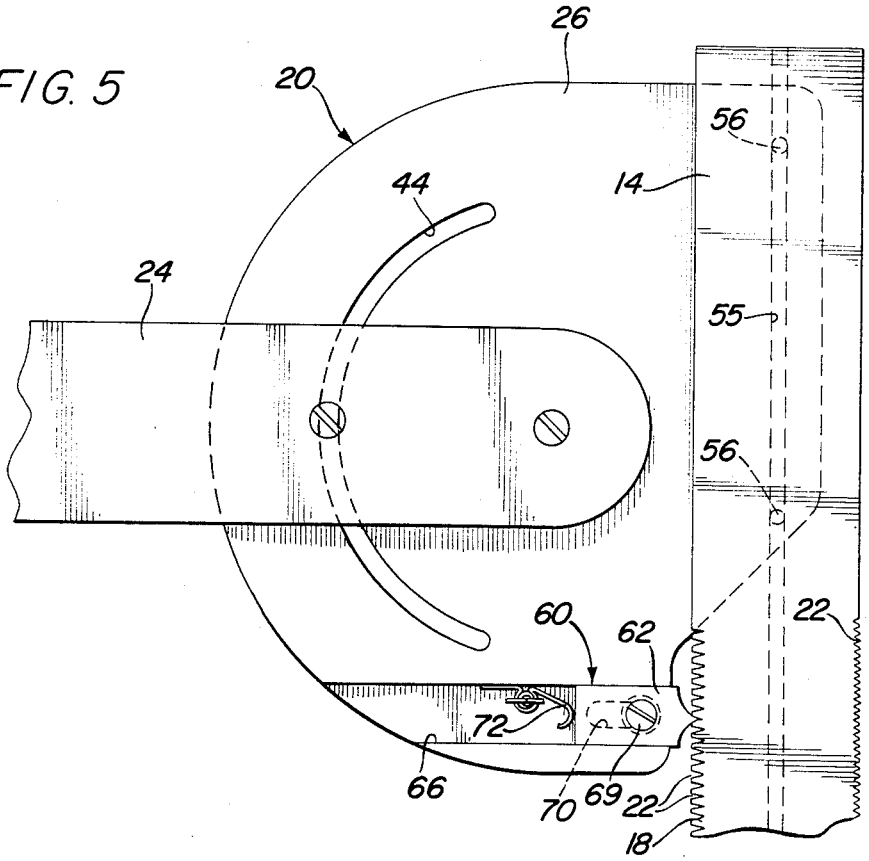
FIG. 5 is a partial bottom-plan view of the scale-guide bar, the base plate and the straight edge.

Furthermore, the assembly is provided with a latching means, indicated generally at 60, which is arranged to be biasly mounted to base plate 26 along the edge thereof formed parallel and adjacent to the notched scale edge 18 of guide bar 14, as seen in FIGS. 1 and 5. Accordingly, straight-edge assembly 20 is automatically locked at a given point, and can not be moved along groove 55 until the latching means 60 is manually operated—that is, until latch tongue 62 is released from engagement with notch 22. Latching means 60 comprises a latching tongue 62 havinq a pointed end 64 which is adapted to be received in any selected notch 22. The latching tongue is slidably mounted in groove 66 formed in the bottom surface of plate 26, as clearly illustrated in FIG. 5. Tongue 62 is attached by means of a release knob 68 which is secured to tongue 62 by screw 69 which passes through slot 60. Thus, tongue 62 is slidably movable in groove 66, and is normally biased into engagement with the notched edge 18 of guide bar 14 by means of spring 72.

As an example, scale 19 is shown having ten notches per inch, so that the lines drawn would be spaced 1/10" apart. Accordingly, latch 62 would engage each notch in consecutive 1/10" increments.

However, straight edge 24 may also be angularly positioned by means of pivot 28 and locking means 40, whereby lines may be drawn at various angles by adjusting straight edge 24, and then tightening pivot means 28 and lock 40.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A self-locking-and-measuring, straight-edge apparatus, comprising:

a scaled guide-bar member adapted to be fixedly secured to a substantially flat-surfaced structure;

a plurality of notches formed along at least one longitudinal edge of said scaled guide-bar member;

a scale having predetermined measures disposed on said scaled guide-bar member, whereby said notches are spaced apart with respect to said scale;

a groove formed longitudinally in said scaled guide-bar member and parallel with said notched edge thereof;

a base-plate member adapted to be slidably mounted to said scaled guide-bar member;

wherein said base-plate member includes means for adjusting the angular position of said straight edge with respect to said scaled guide-bar members;

guide means mounted to said base-plate member and adapted to be slidably received in said longitudinal groove for perpendicular movement along said scaled guide-bar member;

wherein said guide means comprises a pair of aligned guide pins mounted and located in said base plate member, whereby said guide pins are slidably received in said Longitudinal groove of said scaled guide-bar member;

latching means operably attached to said base-plate member for selective engagement with said notches;

wherein said latching means comprises:

a latching tongue adapted to engage selective notches along said edge of said scaled guide-bar member, said latching tongue being slidably attached to said base plate;

a spring positioned to engage said latching tongue in biased engagement with said notches; and a release knob secured to said latching tongue; and a straight edge secured to said base-plate member so as to be positioned normal to said scaled guide-bar member, whereby lines may be drawn horizontal to the scaled guide-bar member.

2. The apparatus as recited in claim 1, wherein said straight-edge-adjusting means comprises:

a pivot means securing one end of said straight edge to said base plate member whereby said straight edge is pivotable from a horizontal position to a selected angular position; and a locking means connected between said base plate member and said straight edge, whereby said straight edge is adapted to be selectively positioned relative to said scaled guide-bar member.

3. The apparatus as recited in claim 2, wherein said locking means comprises:

a threaded pin mounted in said straight edge;

an arcuate slot formed in said base plate member through which said threaded pin passes; and a finger nut threadably mounted to said threaded pin, whereby said finger nut is tightened against said base plate member so as to lock said straight edge in a selective position.

4. The apparatus as recited in claim 3, wherein said latching means includes a groove formed in the bottom surface of said base plate member and adapted to slidably receive said latching tongue therein.

5. The apparatus as recited in claim 2, said scaled guide bar is formed having first and second longitudinal edges, both of said longitudinal edges including a plurality of said notches, wherein said notches of said first longitudinal edge are spaced apart according to said scale adjacently disposed thereto, and wherein said notches of said second longitudinal edge are spaced apart according to said scale adjacently disposed thereto, whereby said oppositely disposed notches are provided with separately arranged scales.

* * * * *